US005921383A

United States Patent [19]

Shefler et al.

[11] Patent Number: 5,921,383

[45] Date of Patent: Jul. 13, 1999

[54] EYEGLASS CASE WITH HINGED COVER

[75] Inventors: Don N. Shefler, Las Vegas, Nev.; Charles H. Newcomer, Wilderville, Oreg.

[73] Assignee: Tec Vision, Inc., Murray, Utah

[21] Appl. No.: 08/833,319

[22] Filed: Apr. 4, 1997

Related U.S. Application Data

[63] Continuation-in-part of application No. 29/041,179, Jul. 7, 1995.

[51] Int. Cl.[6] ..... A45C 11/04; B65D 1/24

[52] U.S. Cl. ..... 206/5; 206/6; 206/38; 220/524

[58] Field of Search ..... 206/5, 5.1, 576, 206/38, 234, 574, 581; 220/523, 524, 526, 553, 555, 324, 326, 837, 826

[56] References Cited

U.S. PATENT DOCUMENTS

| | | | |
|---|---|---|---|
| 51,957 | 1/1866 | Minor . | |
| D. 148,815 | 2/1948 | Olevin . | |
| D. 175,537 | 9/1955 | Combridge . | |
| D. 176,236 | 11/1955 | Stegeman . | |
| D. 179,462 | 12/1956 | Stegeman . | |
| 300,411 | 6/1884 | Borst . | |
| D. 351,945 | 11/1994 | Kopel . | |
| 410,798 | 9/1889 | Long . | |
| 1,004,474 | 9/1911 | Schnorr . | |
| 1,095,744 | 5/1914 | Smith . | |
| 1,277,210 | 8/1918 | Goekel et al. . | |
| 1,427,947 | 9/1922 | Flitton . | |
| 1,469,524 | 10/1923 | McArthur . | |
| 1,486,119 | 6/1924 | Baker | 206/5 |
| 1,503,979 | 8/1924 | Callahan . | |
| 1,633,417 | 6/1927 | Perry . | |
| 1,649,255 | 11/1927 | Robinson . | |
| 1,995,664 | 3/1935 | Boyes . | |
| 1,999,328 | 4/1935 | Lessard . | |
| 2,187,176 | 1/1940 | Schutz . | |
| 2,187,178 | 1/1940 | Schutz . | |
| 2,233,859 | 3/1941 | Wick . | |
| 2,250,636 | 1/1941 | Jerry | 206/5 |
| 2,308,112 | 1/1943 | Schutz . | |
| 2,458,567 | 1/1949 | Cramer . | |
| 2,479,472 | 8/1949 | Coplon . | |
| 2,522,909 | 9/1950 | Wadanoli . | |
| 2,529,000 | 11/1950 | Cameron | 206/5 |
| 2,692,043 | 10/1954 | Davis | 206/5 |
| 2,710,685 | 6/1955 | Baratelli | 206/5 |
| 2,805,766 | 9/1957 | Nathan | 206/5 |
| 3,000,417 | 9/1961 | Goldstein . | |
| 3,050,181 | 8/1962 | Nathan | 206/5 |
| 3,070,141 | 12/1962 | Lowy . | |
| 3,144,127 | 8/1964 | Fogel . | |
| 3,232,638 | 2/1966 | Dishart . | |
| 3,785,480 | 1/1974 | Minasian . | |
| 4,865,186 | 9/1989 | Gates . | |
| 4,899,873 | 2/1990 | Bole et al. | 206/5 |
| 4,951,811 | 8/1990 | Lines . | |
| 4,960,208 | 10/1990 | Tempke . | |
| 4,984,682 | 1/1991 | Cummins | 206/5 |
| 5,014,846 | 5/1991 | Walker et al. | 206/5 |
| 5,016,749 | 5/1991 | Kaye et al. . | |
| 5,085,317 | 2/1992 | Jensen et al. . | |
| 5,249,675 | 10/1993 | Strauss et al. . | |
| 5,333,732 | 8/1994 | Budny et al. | 206/5 |
| 5,344,002 | 9/1994 | Baczkowski | 206/5 |
| 5,513,744 | 5/1996 | Yabarra | 206/5 |
| 5,590,760 | 1/1997 | Astarb | 206/5 |
| 5,706,935 | 1/1998 | Lorton | 206/38 |

*Primary Examiner*—Paul T. Sewell
*Assistant Examiner*—Anthony Stashick

[57] ABSTRACT

An eyeglass case includes top and bottom substantially rigid shell members connected by a hinge for movement between open and closed positions. In the closed position, the shell members define an enclosed interior space adapted for protective storage of eyeglasses. The top and bottom shell members each include an interior end portion provided with an internal receptacle for storage of miscellaneous accessory items such as nose pads, spare screws, a small screwdriver, lens cleaning solution, and a lens wiping cloth. The internal receptacles include floor portions configured complementary to the articles stored therein and hinged lids for maintaining the stored items securely in position.

20 Claims, 3 Drawing Sheets

EYEGLASS CASE WITH HINGED COVER

CROSS-REFERENCE TO RELATED APPLICATIONS

This application is a continuation-in-part of U.S. Design patent application Ser. No. 29/041,179, filed Jul. 7, 1995. The entire disclosure of the above-captioned application is hereby incorporated by reference herein.

BACKGROUND OF THE INVENTION

The present invention relates to eyeglass cases and more particularly pertains to an eyeglass case having internal compartments for storing accessory items.

SUMMARY OF THE INVENTION

The present invention discloses an eyeglass case generally comprising top and bottom substantially rigid shell members connected by a hinge for movement between open and closed positions. In the closed position, the shell members define an enclosed interior space adapted for protective storage of eyeglasses. In accordance with one embodiment of the invention, the top and bottom shell members each include an interior end portion provided with an internal receptacle for storage of miscellaneous accessory items such as nose pads, spare screws, a small screwdriver, lens cleaning solution, and a lens wiping cloth. In accordance with one embodiment of the invention, the internal receptacles include floor portions configured complementary to the articles stored and hinged lids for maintaining the stored items securely in position.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

Figure 1:
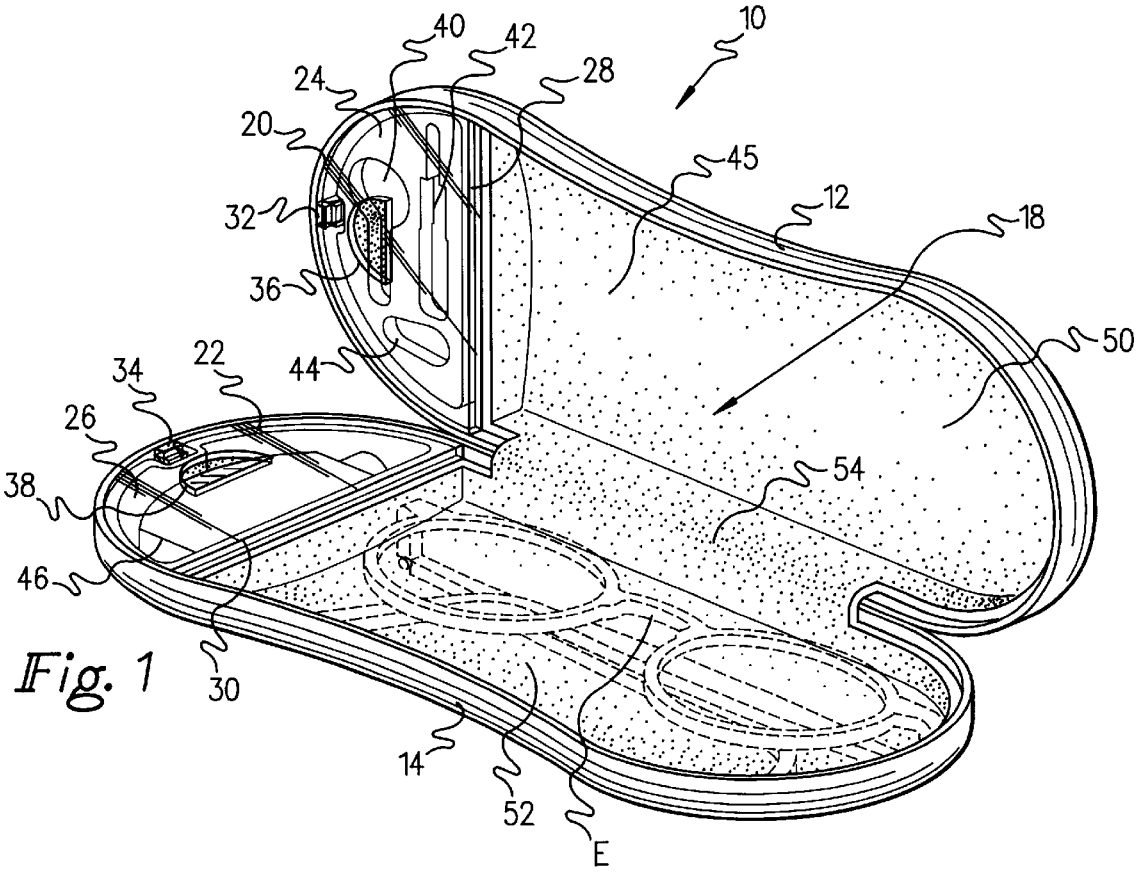
FIG. 1 is a perspective view illustrating an eyeglass case according to the present invention, with top and bottom shell members disposed in an open position.
Figure 2:
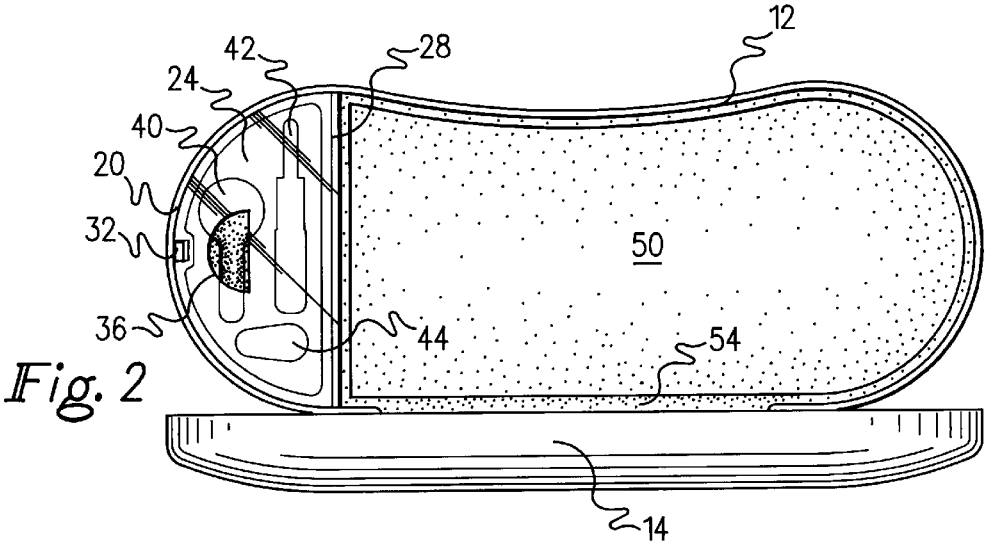
FIG. 2 is a front elevational view illustrating the eyeglass case according to the present invention, with top and bottom shell members disposed in an open position.
Figure 3:
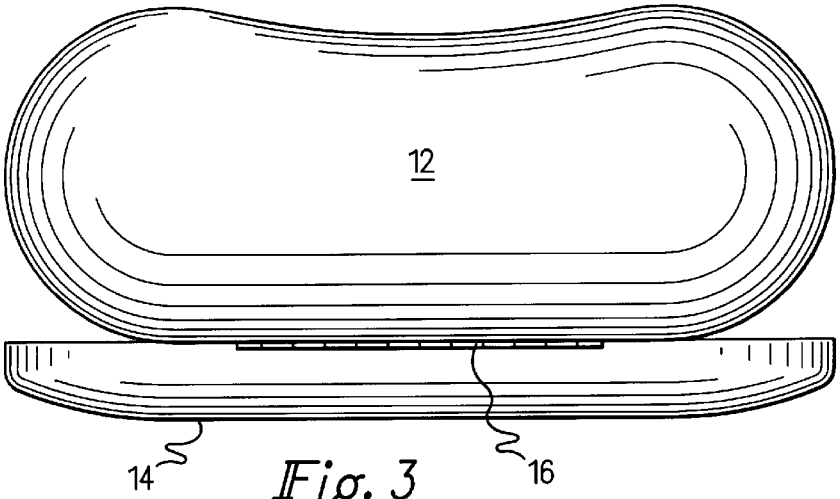
FIG. 3 is a rear elevational view illustrating the eyeglass case according to the present invention, with top and bottom shell members disposed in an open position.
Figure 4:
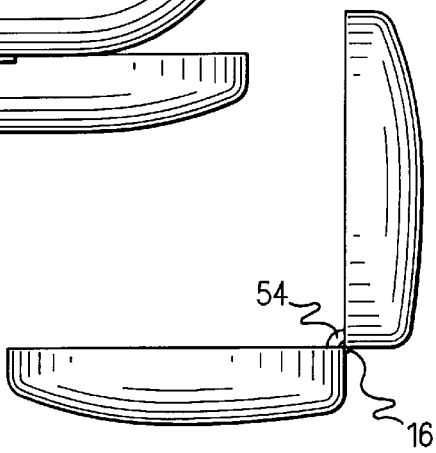
FIG. 4 is an end elevational view illustrating the eyeglass case according to the present invention, with top and bottom shell members disposed in an open position.
Figure 5:
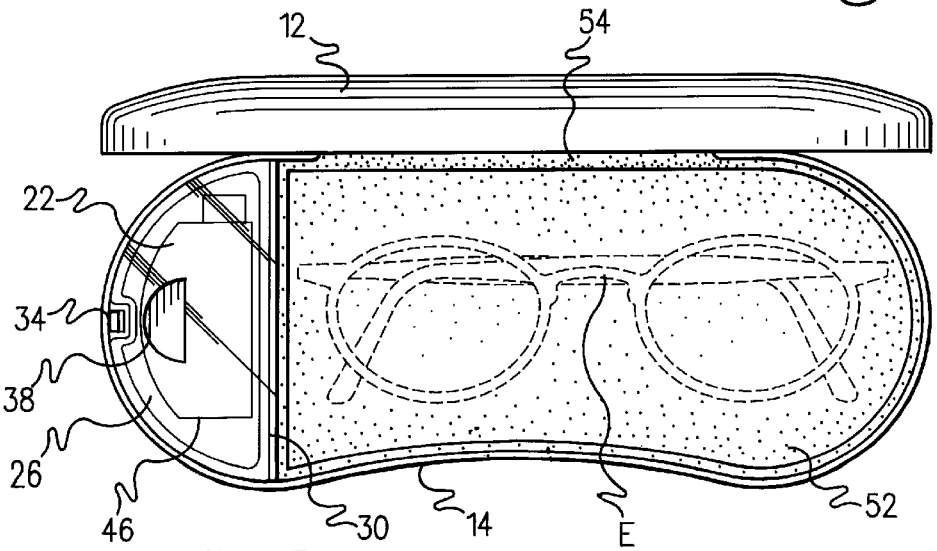
FIG. 5 is a top plan view illustrating the eyeglass case according to the present invention, with top and bottom shell members disposed in an open position.
Figure 6:
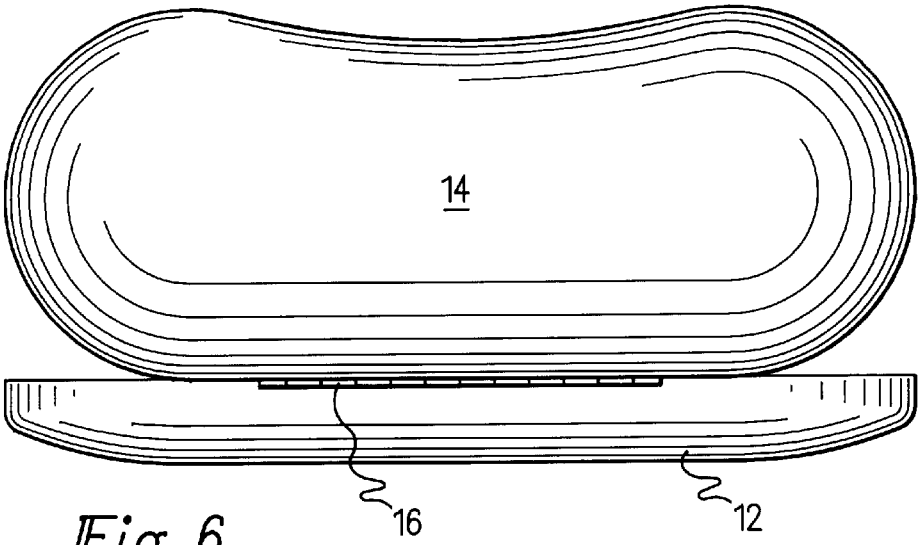
FIG. 6 is a bottom plan view illustrating the eyeglass case according to the present invention, with top and bottom shell members disposed in an open position.
Figure 7:
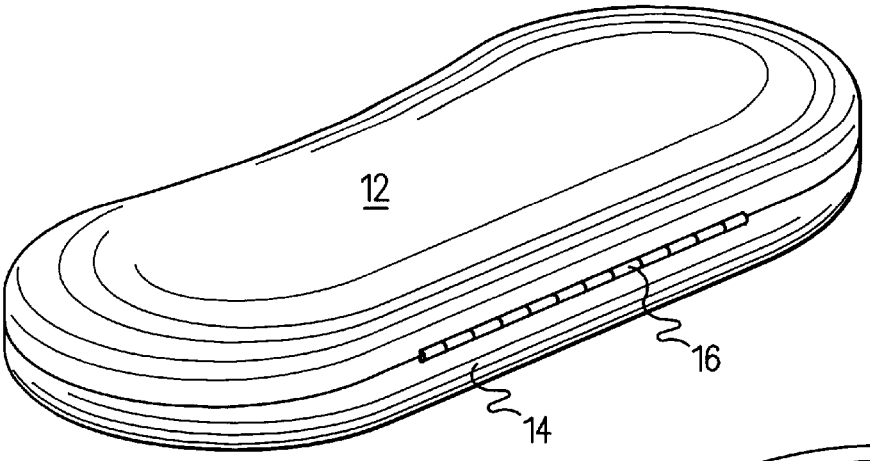
FIG. 7 is a top perspective view illustrating the eyeglass case according to the present invention, with top and bottom shell members disposed in a closed position.
Figure 8:
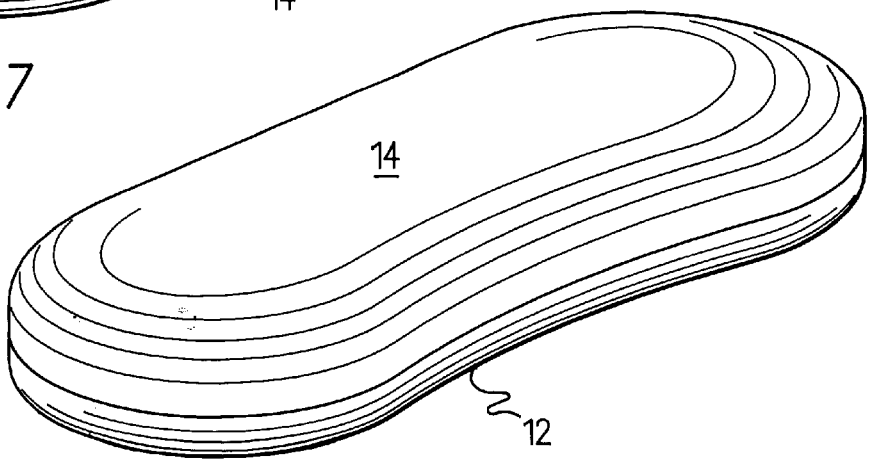
FIG. 8 is a bottom perspective view illustrating the eyeglass case according to the present invention, with top and bottom shell members disposed in a closed position.

Referring now to the drawings, wherein like reference numerals designate corresponding structure throughout the views, and referring in particular to FIGS. 1–8, an eyeglass case 10 according to an example preferred embodiment of the present invention includes a top shell member 12 connected by a first hinge 16 to a bottom shell member 14 for movement about a longitudinally extending axis of rotation between open and closed positions. In a closed position, the shell members 12 and 14 define an enclosed interior space 18 dimensioned and disposed for the protective storage of eyeglasses E therein. While the illustrated elongated oval shape of the shell members 12 and 14 is preferred, other configurations such as rectangular, etc. may be employed without departing from the scope and content of the instant invention. A pair of respective interior receptacles 20 and 22 disposed in overlying end regions of the top 12 and bottom 14 shell members of the case 10 include respective hinged lids 24 and 26 mounted for limited pivotal rotational movement between open and closed positions about the axis of respective hinge members 28 and 30. Respective resilient latch or catch members 32 and 34 selectively secure the pivotal lids 24 and 26 in the illustrated closed position for the purpose of the securement of miscellaneous accessory items therein. The interior receptacles 20 and 22 preferably each include at least one recessed floor portion configured complimentary to at least one accessory item adapted for storage therein. For example, the receptacle 20 includes interior recessed floor portions 40, 42, and 44 configured, respectively, for the storage of a small magnifying glass, a small screwdriver, and eyeglass nose pads. The interior receptacle 22 associated with the bottom shell member 14 may, for example, be provided with a recessed interior floor portion 46 configured for the receipt of a small bottle of lens cleaning solution. As may now be readily understood, securement of the receptacle lids 24 and 26 in the illustrated closed positions, in conjunction with the recessed interior floor portions of the receptacles 20 and 22, securely retains the various miscellaneous accessory items therein. In order to remove the items for use, an individual inserts a finger tip into the respective cut-outs 36 and 38 formed in the lids 24 and 26.

A liner 48, preferably integrally formed, includes respective first 50 and second 52 portions disposed within the top 12 and bottom 14 shell members suitable adhesives are preferably employed to secure the liner to the shells. A medial portion of the liner 48 overlies an interior side of the hinge 16 and connects the liner portions 50 and 52 in a relatively moveable manner. Toward this end, the liner 48 is preferably integrally formed of a suitably flexible material to permit movement of the top 12 and bottom 14 shell members between the open position illustrated in FIG. 1 and the closed position illustrated in FIG. 7.

Accordingly, the present invention provides an extremely economical compact and light weight case 10 affording protective storage for eyeglasses E, in addition to permitting the convenient transport and ready availability of occasionally needed eyeglass accessory items such as a small screwdriver and spare screws for repairing eyeglass frames, nose pads for placement on eyeglass nose pieces, a small magnifying glass to assist in effecting repair of frame screws, and cleaning solution and a soft lens wiping cloths to permit convenient lens cleaning.

A wide variety of materials such as plastic, metal, leather, fabric, expanded foam materials, paper, and the like, may be used in the construction of the eyeglass case 10 according to the present invention, without departing from the intended scope of the claims appended hereto. In addition, the location, number, position, and relative orientation of the interior receptacles 20 and 22 may be varied in a wide variety of possible permutations within the scope of the instant invention.

It is to be understood, however, that even though numerous characteristics and advantages of the present invention have been set forth in the foregoing description, together with details of the structure and function of the invention, the disclosure is illustrative only, and changes may be made in detail, especially in matters of materials, shape, size and arrangement of parts within the principles of the invention to the full extent indicated by the broad general meaning of the terms in which the appended claims are expressed, and reasonable equivalents thereof.

What is claimed is:

1. An eyeglass case, comprising:

top and bottom shell members connected by a first hinge for movement about an axis of rotation between open and closed positions;

said shell members in said closed position defining a substantially enclosed interior space adapted for protective storage of eyeglasses;

said top shell member including a first interior receptacle adapted for storage of at least one accessory item;

said bottom shell member including a second interior receptacle adapted for storage of at least one accessory item;

said first and second interior receptacles disposed in overlying end regions of said top and bottom shell members with said case disposed in a closed position;

each of said interior receptacles including a recessed floor portion configured complementary to at least one accessory item adapted for storage therein;

a pair of lids for selectively closing respective ones of said interior receptacles;

respective second and third hinges mounting respective ones of said lids for movement between open and closed positions;

said second and third hinges mounting respective ones of said lids for movement about axes substantially transverse to said rotational axis of said first hinge;

a liner having a first portion disposed in said top shell and a second portion disposed within said bottom shell;

said liner including a medial portion connecting said first and second portions of said liner;

said first, second and medial portions of said liner integrally formed; and said medial portion of said liner overlying said first hinge and formed from a flexible material to permit relative movement of said top and bottom shell members between open and closed positions.

2. The eyeglass case of claim 1, further comprising a pair of resilient catch members for selectively securing respective ones of said lids in closed positions.

3. The eyeglass case of claim 1, wherein one of said first and second interior receptacles contains a magnifying glass.

4. The eyeglass case of claim 1, wherein one of said first and second interior receptacles contains a screwdriver.

5. The eyeglass case of claim 1, wherein one of said first and second interior receptacles contains a bottle of lens cleaning solution.

6. The eyeglass case of claim 1, wherein one of said first and second interior receptacles contains at least one spare screw.

7. The eyeglass case of claim 1, wherein one of said first and second interior receptacles contains at least one nose pad.

8. The eyeglass case of claim 1, wherein one of said first and second interior receptacles contains a magnifying glass, at least one spare screw, and at least one nose pad, and the other of said receptacles contains a bottle of lens cleaning solution.

9. An eyeglass case, comprising:

top and bottom shell members connected by a first hinge for movement about an axis of rotation between open and closed positions;

said shell members in said closed position defining a substantially enclosed interior space adapted for protective storage of eyeglasses;

said top shell member including a first interior receptacle adapted for storage of at least one accessory item;

said bottom shell member including a second interior receptacle adapted for storage of at least one accessory item;

said first and second interior receptacles disposed in overlying end regions of said top and bottom shell members with said case disposed in a closed position;

each of said interior receptacles including a recessed floor portion configured complementary to at least one accessory item adapted for storage therein;

a pair of lids for selectively closing respective ones of said interior receptacles;

respective second and third hinges mounting respective ones of said lids for movement between open and closed positions; and said second and third hinges mounting respective ones of said lids for movement about axes substantially transverse to said rotational axis of said first hinge.

10. The eyeglass case of claim 9, further comprising a pair of resilient catch members for selectively securing respective ones of said lids in closed positions.

11. The eyeglass case of claim 9, wherein one of said first and second interior receptacles contains a magnifying glass.

12. The eyeglass case of claim 9, wherein one of said first and second interior receptacles contains a screwdriver.

13. The eyeglass case of claim 9, wherein one of said first and second interior receptacles contains a bottle of lens cleaning solution.

14. The eyeglass case of claim 9, wherein one of said first and second interior receptacles contains at least one spare screw.

15. The eyeglass case of claim 9, wherein one of said first and second interior receptacles contains at least one nose pad.

16. The eyeglass case of claim 9, wherein one of said first and second interior receptacles contains a magnifying glass, at least one spare screw, and at least one nose pad, and the other of said receptacles contains a bottle of lens cleaning solution.

17. An eyeglass case, comprising:

top and bottom shell members connected by a first hinge for movement about an axis of rotation between open and closed positions;

said shell members in said closed position defining a substantially enclosed interior space adapted for protective storage of eyeglasses;

said top shell member including a first interior receptacle adapted for storage of at least one accessory item;

said bottom shell member including a second interior receptacle adapted for storage of at least one accessory item;

said first and second interior receptacles disposed in overlying end regions of said top and bottom shell members with said case disposed in a closed position;

each of said interior receptacles including a recessed floor portion configured complementary to at least one accessory item adapted for storage therein; and one of said first and second interior receptacles containing a magnifying glass, at least one spare screw, and at least one nose pad, and the other of said receptacles containing a bottle of lens cleaning solution.

18. The eyeglass case of claim 17, further comprising:

a pair of lids for selectively closing respective ones of said interior receptacles;

respective second and third hinges mounting respective ones of said lids for movement between open and closed positions; and said second and third hinges mounting respective ones of said lids for movement about axes substantially transverse to said rotational axis of said first hinge.

19. The eyeglass case of claim 18, further comprising a pair of resilient catch members for selectively securing respective ones of said lids in closed positions.

20. The eyeglass case of claim 17, further comprising:

a liner having a first portion disposed in said top shell and a second portion disposed within said bottom shell;

said liner including a medial portion connecting said first and second portions of said liner;

said first, second and medial portions of said liner integrally formed; and said medial portion of said liner overlying said first hinge and formed from a flexible material to permit relative movement of said top and bottom shell members between open and closed positions.

* * * * *